United States Patent [19]

Jacobson

[11] Patent Number: 4,483,037

[45] Date of Patent: Nov. 20, 1984

[54] BLIND CLEANING DEVICE

[76] Inventor: Jeff A. Jacobson, 22 Woodgrove, Irvine, Calif. 92714

[21] Appl. No.: 443,334

[22] Filed: Nov. 22, 1982

[51] Int. Cl.[3] ..... A47L 4/02

[52] U.S. Cl. ..... 15/210 A; D4/119

[58] Field of Search ..... 15/160, 210 A, 210 R, 15/394; D4/1, 8; 401/10; 134/6

[56] References Cited

U.S. PATENT DOCUMENTS

| | | | |
|---|---|---|---|
| 2,084,485 | 6/1937 | Fink | 15/210 A |
| 2,172,479 | 9/1939 | McMillen | 15/160 X |
| 2,276,264 | 3/1942 | Goldfinger | 15/210 |
| 2,571,906 | 10/1951 | Love | 15/210 |
| 2,663,046 | 12/1953 | Goguen | 15/160 X |
| 2,789,307 | 4/1957 | Sussman et al. | 15/210 A |
| 2,957,190 | 10/1960 | Stark | 15/121 |
| 4,084,478 | 4/1978 | Bailes et al. | 15/210 |

FOREIGN PATENT DOCUMENTS

| | | | |
|---|---|---|---|
| 2742001 | 12/1966 | Australia | 15/210 A |
| 0009016 | 8/1979 | European Pat. Off. . | |
| 870618 | 6/1961 | United Kingdom . | |
| 1071271 | 6/1967 | United Kingdom | 15/210 |
| 1271508 | 4/1972 | United Kingdom . | |
| 1402358 | 8/1975 | United Kingdom . | |

*Primary Examiner*—Edward L. Roberts

*Attorney, Agent, or Firm*—Poms, Smith, Lande & Rose

[57] ABSTRACT

A blind cleaning device having a handle and a plurality of spaced fingers extending from the handle. Blind cleaning elements are provided on the fingers and the slats of the blind are insertible between the elements. The fingers are moved in unison from the handle to squeeze or clamp the slats therebetween. Movement of the device, when the fingers are moved to clamp the slats therebetween, along the blind slats, efficiently cleans all surfaces of the slats in a single pass. The cleaning elements may be fake fur or lambs' wool and coated with a dust attracting cleaning agent prior to cleaning the blind slats.

7 Claims, 5 Drawing Figures

10
11
12
13
14
15
16
17
18
19
20
21
22
23
24
25
26
27
28
III
IV
X

BLIND CLEANING DEVICE

BACKGROUND OF THE INVENTION

1. Field of the Invention

The invention relates to blind cleaning devices: and, more particularly, to a device insertible between slats of venetian blinds and movable there along to clean the same.

2. Description of the Prior Art

One of the most distasteful household cleaning jobs is the efficient cleaning of venetian blinds or mini-blinds. Unfortunately, such blinds are as popular today as they have been in the past and various devices have been suggested over the years for cleaning the same. In U.S. Pat. No. 2,172,479 to McMillen, a venetian blind duster is shown using fur or hair bristles 14. The finger members 6 are fixed and such bristles merely move dust from one location on the slat to another and bind in the ropes interconnecting the slats.

In U.S. Pat. No. 2,276,264 to Goldfinger, a duster is shown having flexible fingers but the fingers merely flex, cannot open to be inserted between slats of a blind and do not move in unison toward each other to clamp a blind slat therebetween. In U.S. Pat. No. 2,571,906 to Love, a blind cleaner is disclosed having spring-biased fingers 12 covered with cleaning pads 19. Only two fingers 12 are disclosed, the pads 19 are very close together, the material of pads 19 is not disclosed and the device is relatively expensive to manufacture. Also, contiguous slats cannot be cleaned simultaneously.

In U.S. Pat. No. 2,957,190 to Stark, a louver cleaner is disclosed having sponges 19 for cleaning louvers. Obviously, successive slats cannot be cleaned simultaneously. A similar divice which cannot simultaneously clean slats is disclosed in British Patent No. 1,071,271 to Warner where sponge pads 13, 14 are on only one side of spaced arms 11, 12.

It can thus be seen that none of the prior art patents except McMillen and Goldfinger can simultaneously clean more than two slats at a time. McMillen's bristles are very inefficient and can bind on the ropes interconnecting the blinds. Goldfinger's fingers do not move together in unison and cannot clasp a plurality of contiguous slats therebetween for simultaneous cleaning thereof. None of the known prior art divices have achieved commercial success due to their inefectiveness in cleaning blinds.

There thus is a need for an economical and easy to manufacture cleaning device for efficiently cleaning all surfaces of blinds in a single pass and removing dirt and dust therefrom.

SUMMARY OF THE INVENTION

It is an object of this invention to provide an improved blind cleaning device which is adapted to clean efficiently and simultaneously a plurality of contiguous blind slats.

It is a further object of this invention to provide such a device which clamps the slats therebetween for efficient cleaning thereof.

It is still another object of this invention to provide such a device having cleaning elements which can be removed for cleaning in ordinary water and may be sprayed or coated with a dust attracting cleaning agent prior to use thereof.

These and other objects are preferably accomplished by providing a blind cleaning device having a handle and a plurality of spaced fingers extending from the handle. Blind cleaning elements are provided on the fingers and the slats of the blind are insertible between the elements. The fingers are moved in unison from the handle to squeeze the slats therebetween. Movement of the device, when the fingers are moved to clamp the slats, along the blind slats, efficiently cleans all surfaces of the slats in a single pass. The cleaning elements may be fake fur or lambs' wool and coated with a dust attracting cleaning agent prior to cleaning the blind slats.

DESCRIPTION OF THE PREFERRED EMBODIMENT

Figures 1, 2, 3, 4, 5:
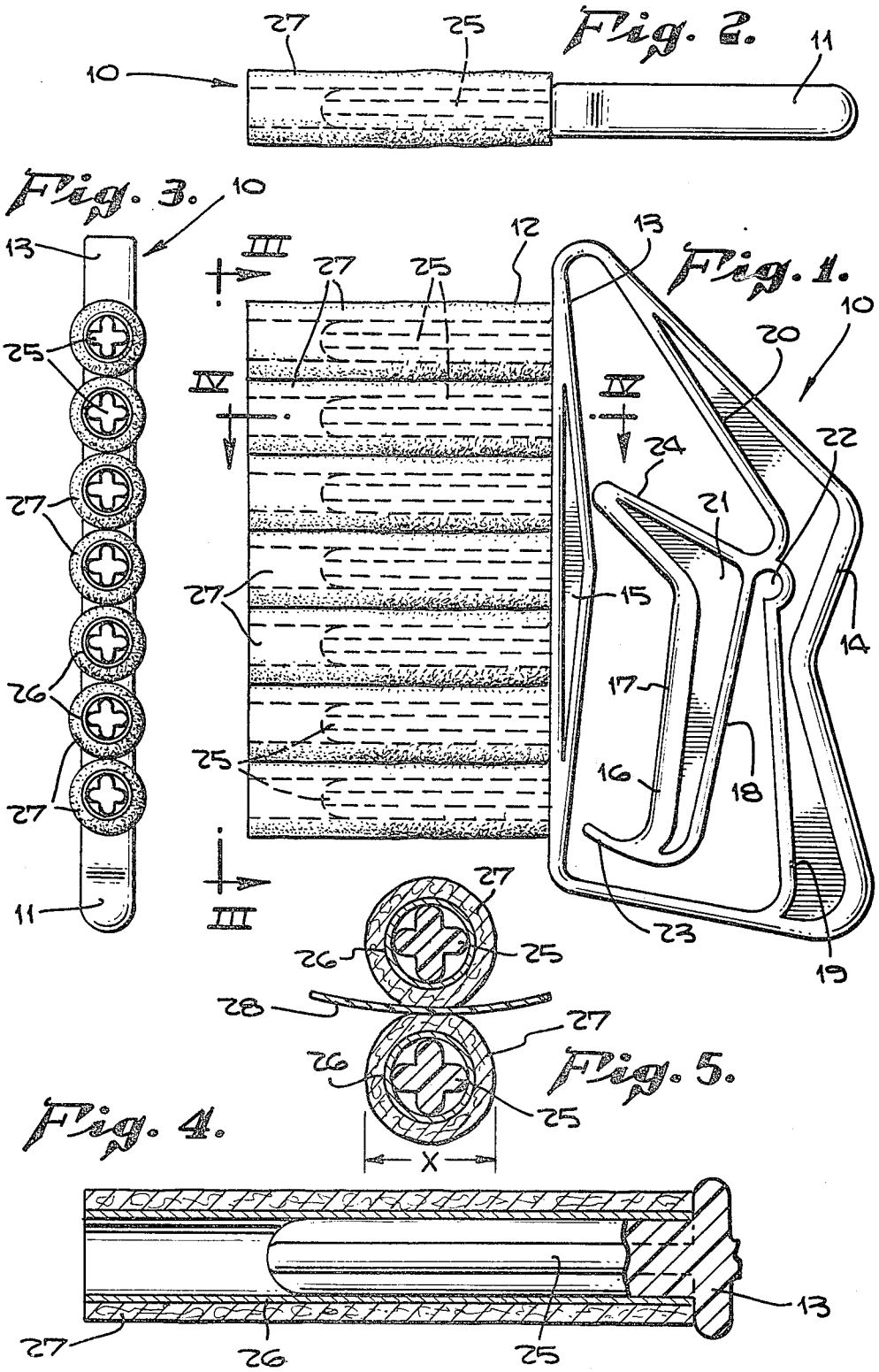
FIG. 1 is a vertical view of a cleaning device in accordance with the inventions.
FIG. 2 is an end view of the device of FIG. 1.
FIG. 3 is a view taken along lines III—III of FIG. 1.
FIG. 4 is a view taken along lines IV—IV of FIG. 1 showing cleaning material on the brush in cross-section.
FIG. 5 is a view similar to FIG. 3 showing a pair of the fingers thereof with the cleaning material disposed thereon.

Referring now to FIG. 1 of the drawing, a cleaning device 10 is shown having a hand grip portion 11 and a blind cleaning portion 12. Hand grip portion 11 is comprised of an open framework having an elongated finger support portion 13 and an outer peripheral frame portion 14. Portions 13 and 14 may be integral as shown and an elongated generally triangular space 15 may be provided along portion 13 as shown. An interior finger grip portion 16 is provided having a generally concave front area 17 and a generally straight back area 18. A support section 19 interconnects area 18 to the bottom of outer framework portion 14. In like manner, a support section 20 interconnects area 18 to the top of outer framework portion 14. A central elongated open generally triangular area 21 is provided in section 16 and the intersection of sections 18, 19 and 20 may be an open circular area 22. As shown, the finger grip portion 16 curves at the bottom at curved portion 23 and the upper portion of section 16 is generally V-shaped at portion 24, as shown.

As seen in FIGS. 1 and 2, a plurality of vertically spaced resilient rigid elongated fingers 25 are integral with and extend from portion 13. As shown in FIG. 3, each finger 25 is generally cross-shaped in cross-section.

As shown in FIGS. 4 and 5, a hollow tube 26, such as cardboard or plastic, is adapted to fit snugly onto each finger 25. Each tube 26 includes a cleaning material 27 secured on the outer peripheral surface thereof. As seen particularly in FIG. 5, the outer surface of adjacent material 27 is contiguous but material 27 is a generally soft deformable material, as will be discussed, so that the slats of a venetian blind may be disposed therein, such as slat 28 in FIG. 5, and the device 10 moved therealong to clean the same.

Although seven fingers 25 are shown in FIG. 3, obviously any suitable number may be used, even as few as two (similar then to the view in FIG. 5). Also, tubes 26 may snugly fit into fingers 25 but removable therefrom for either replacement or cleaning. For example, the material 27 may be lambs' wool or fake fur of nylon or polyester fiber or the like which will pick up dust and yet can be cleaned in soap and warm water. The fur can of course be glued or otherwise adhered to tubes 26. In addition, the material 27 may be sprayed or otherwise coated with a dust attracting cleaning agent prior to use allowing efficient cleaning. As hetetofore stated, known prior art devices, such as bristletype cleaning devices, merely smear or move the dirt or dust from one are of the blind to another resulting in in inefficient cleaning.

The handle portion 11 (and all components save tubes 26 and material 27) may be of a suitable plastic, preferably molded from one piece. For example, the entire handle 11 and fingers 12 may be of one piece of molded polypropylene. The tubes 26, as mentioned, may be of cardboard or extruded plastic.

As shown in FIG. 1, gripping trigger portion 16 moves section 24 camming section 24 against the triangular portion of section 13 thereby moving fingers 25 to open them slightly. As shown in FIG. 5, the fingers 25 are now insertible between the slats 28 of a blind, released to clamp the slats therein, and moved along the slats to clean the same. The fur or similar material 27 attracts dust due to its synthetic fibers and static cling inherent therein, and, particularly when sprayed with a dust attracting agent, picks up the dust more efficiently. The configuration of the framework of handle 11 effects such movement of fingers 25. Of course, any suitable handle may be provided and the fingers moved in any suitable manner. For example, although fingers 25 are shown in FIG. 1 as linearly extending from section 13 and flexed with trigger 16 is actuated, obviously it is well within the skill of the artisan to make the fingers 25 closer together and move away from each other when trigger 16 is actuated. That is, the fingers may be normally closed (FIG. 5) and open when trigger 16 is compressed. Also, although the entire hand grip (framework) 11 may be of one piece molded plastic, obviously the hand grip 11 may be comprised of separate sections, such as a conventional spring-actuated trigger, adapted to move fingers 25 when pressed.

Although slat 28 is shown as curved in cross-section and such slats are generally flexible so that they are flattened by engagement of fingers 25 and material 27 as seen in FIG. 5. The overall diameter X (FIG. 5) may be generally related to the flattened width of the slats 28 so that a single pass of device 10 along the slats cleans the entire slat.

The device 10 of FIG. 1 is very comfortable to use and has a convenient grip and angle and works efficiently with all types of blinds. Generally, so-called commercial mini-blinds are one inch or so in width and about $\frac{3}{4}''$ apart. Conventional venetian blinds are about two inches in width and spaced about 1 and $\frac{5}{8}$ inches apart. The device 10 disclosed herein cleans more than one blind slat at a time no matter what type of slats are being cleaned.

The entire device 10 can be washed in water or the tubes 26 (and adhered material 27) can be removed and replaced or cleaned. In fact, the tubes 26 can be washed in a conventional washer and dryer. Although the device 10 can be used without the addition of a dust attracting cleaning agent, it is particularly well suited to cleaning with such agents.

Although the device 10 has been disclosed with particular reference to cleaning vertical or horizontal blinds and shutters of any suitable material, such as wood, plastic, fabric, etc., it can also be used as a general purpose cleaning device for the tops of doors, pictures, etc.

The specific dimension and shape of member 13 and the connection fingers 25 thereto are chosen to allow finger 25 to spread substantially the same distance apart at the time of squeezing of trigger 23. If fingers 25 do not flex substantially the same distance apart at the same time, all of the fingers 25 might not be able to go into the small space between the slats of the blind. The shape and angle of curvature of trigger 23 is selected to provide proper engagement of portion 24 with portion 13 when the trigger is squeezed to permit a predetermined degree of engagement of portions 24 and 13 to permit equal flexing of the giners. As previously stated, if equal spacing isn't achieved, one or more of the fingers might not be able to enter one or more of the spacings between the slats.

It can be seen that I have disclosed a unique and novel cleaning device particularly well suited to the cleaning of mini-blinds, slats or venetian blinds.

I claim:

1. In a blind cleaning device having a handle and a plurality of vertically spaced rigid fingers with cleaning elements extending from the handle, the improvement which comprises:

finger moving means interconnecting said fingers to said handle so that all of said fingers may be moved in unison simultaneously to clamp a blind slat between respective adjacent fingers with said cleaning elements being adapted to clean the entire surface of said clamped slats in a single pass of said slats; and said finger moving means including a movable trigger on said handle and a main support having said fingers connected to said support and extending therefrom and a camming portion on said trigger adapted to cam against said main support when said trigger is squeezed to thereby move said main support which moves the fingers connected thereto.

2. In the device of claim 1 wherein said main support, said fingers and said trigger are an integral unitary piece of molded plastic material.

3. In the device of claim 1 wherein each of said fingers is X-shaped in cross-section.

4. In the device of claim 1 wherein at least seven such fingers are provided on said device.

5. In a blind cleaning device having a handle and a plurality of vertically spaced rigid fingers with cleaning elements extending from the handle, the improvement which comprises:

finger moving means interconnecting said fingers to said handle so that all of said fingers may be moved in unison simultaneously to clamp a blind slat between respective adjacent fingers with said cleaning elements being adapted to clean the entire surface of said clamped slats in a single pass of said slats, said cleaning elements including removable sleeves slidably and removably mounted on each of said fingers for cleaning of such elements.

6. In the device of claim 5 wherein each of said sleeves includes an elongated tube snugly fitting onto each of said fingers, each of said cleaning elements including a synthetic fur material secured to substantially the entire outer surface of each of said tubes.

7. In a blind cleaning device having a handle and a plurality of vertically spaced rigid fingers with cleaning elements thereon extending from a main support on said handle, the improvement which comprises:

finger moving means between the handle and said main support for flexing said main support so that all of said fingers may be moved in unison simultaneously and substantially the same distance apart from one another so as to clamp a blind slat betweem respective adjacent fingers with said cleaning elements being adapted to clean the entire surface of said clamped slats in a single pass of said slats.

* * * * *